United States Patent [19]

Howard

[11] Patent Number: 4,865,463

[45] Date of Patent: Sep. 12, 1989

[54] SYSTEM FOR HANDLING HOSIERY ARTICLES

[75] Inventor: Leonard Howard, Pfafftown, N.C.

[73] Assignee: Sara Lee Corporation, Winston-Salem, N.C.

[21] Appl. No.: 197,746

[22] Filed: May 23, 1988

[51] Int. Cl.[4] ..... B65D 33/00

[52] U.S. Cl. ..... 383/33; 383/99; 383/117

[58] Field of Search ..... 383/8, 9, 17, 18, 20, 383/33, 61, 97, 99, 117; 190/903; 248/99

[56] References Cited

U.S. PATENT DOCUMENTS

| | | | |
|---|---|---|---|
| 1,307,439 | 6/1919 | Farnsworth et al. | 383/33 X |
| 1,859,970 | 5/1932 | Kaufmann | 383/61 X |
| 2,079,592 | 5/1937 | Battin | 383/33 X |
| 2,602,482 | 7/1952 | Lyon | 383/97 |
| 2,669,272 | 2/1954 | Permann | 150/1 |
| 3,422,867 | 1/1969 | Wu | 150/3 |
| 3,674,073 | 7/1972 | Hendon | 150/7 |
| 3,998,304 | 12/1976 | Edgerton, Jr. et al. | 190/48 |
| 4,204,565 | 5/1980 | Nohmura | 383/99 |
| 4,249,663 | 2/1981 | Hewlett | 383/97 X |
| 4,630,312 | 12/1986 | Milstein | 383/117 X |
| 4,646,802 | 3/1987 | Basore et al. | 383/33 X |

FOREIGN PATENT DOCUMENTS

| | | | |
|---|---|---|---|
| 2063212 | 6/1981 | United Kingdom | 383/18 |
| 2164547 | 3/1986 | United Kingdom | 383/33 |

*Primary Examiner*—Stephen Marcus
*Assistant Examiner*—Nova Stucker
*Attorney, Agent, or Firm*—Charles Y. Lackey; William S. Burden

[57] ABSTRACT

A system of handling delicate articles such as hosiery wherein the articles are collected in an orderly fashion and maintained in an elongated, oriented manner during transport between work stations, and during various operations performed on the articles such as autoclaving, dyeing, etc. The system includes the use of a hosiery article receiving and transporting bag of open mesh construction having a slide fastener closure, fabric flaps for protecting the articles from the fastener, spaced ties for maintaining the article orientation, and handles for lifting and or transporting the filled bag.

7 Claims, 3 Drawing Sheets

SYSTEM FOR HANDLING HOSIERY ARTICLES

This invention relates generally to the handling of delicate articles and more particularly to a new and improved system for collecting articles tubular hosiery blanks, stockings, pantyhose and the like after a work operation and transporting the articles, while maintained in an orderly fashion, for use in subsequent operations.

The system includes a new carrier or bag construction for receiving articles therein in an oriented manner and for transporting the articles to one or more subsequent work stations. The hosiery articles may be supplied from knitting machines or other sources and selectively transferred to various operations which may include an autoclave, line closer machines, toe closer machines, and dyeing and boarding operations.

The bag is of a length greater than the length of the hosiery articles for receiving the articles therein in an extended, generally parallel fashion. The bag, after being filled with articles and closed includes means for eliminating or greatly reducing movement of the articles therein when being transported from one operation to another, thereby eliminating tangling and reducing picks resulting in better quality articles. The bag also provides means for transferring goods quicker and easier between various operations.

The bag is formed of a durable open weave construction having the upper edges provided with a slide fastener. The bag also is provided with one or more flaps for protecting the articles from the slide fastener, spaced ties, portions of which are secured to the bag fabric, and handles for facilitating lifting of the filled bag.

One of the primary objects of the invention is the provision of a new and improved system for handling delicate, flexible articles.

Another object of the invention is the provision of a system for orienting a plurality of articles in a support bag in a prescribed manner, and retaining the oriented articles in a secured manner during transport of the articles, and during autoclaving and dyeing of the articles.

A further object of the invention is the provision of a novel, easy handling bag of economical, open-mesh construction which insures safe retention of the articles while reducing tangling and the likelihood of damage to the goods.

Still another object of the invention is the provision of a system which is economical and requires substantially less manipulative operations resulting in increased production and reduced costs.

Other objects, features and advantages of the invention will become apparent when considered in view of the following detailed description.

DETAILED DESCRIPTION OF THE INVENTION

Figure 1:
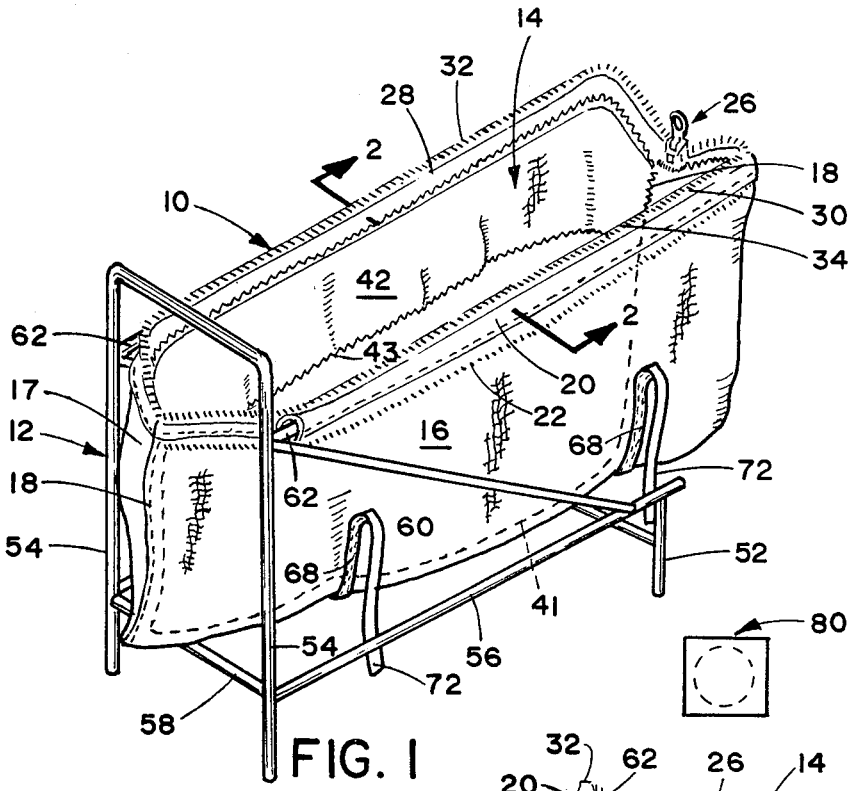
FIG. 1 is a perspective view of one embodiment of the bag of the novel system which is in an opened condition upon a support apparatus.

FIG. 1 of the drawing illustrates a preferred embodiment of a carrier or bag 10 of the present invention supported in an opened condition upon one embodiment of a support frame 12. The bag is of generally rectangular configuration with the opening or mouth 14 at the top thereof when mounted upon support frame 12.

The bag fabric, preferrably of polyester, has a soft feel and is open-mesh construction for permitting the free flow of liquids and gases therethrough. The rectangular bag includes opposed side Wall panels 16, 17, which may be of integral construction, stitched together at the opposite ends thereof as at 18,18. The upper edge portions 20,20 of each of the panels 16,17 is folded upon itself and stitched as at 22 to define elongated openings 24,24 for receiving bag supporting members as will be subsequently described.

The bag is closed by fastener means which, in the preferred embodiment is a zipper type fastener 26 including two tapes 28,30 having coacting zipper elements 32,34 fixed thereto. Tape 28 is secured to the uppermost edge of panel 17 and tape 30 is sewn to the uppermost edge of panel 16.

Figure 6:
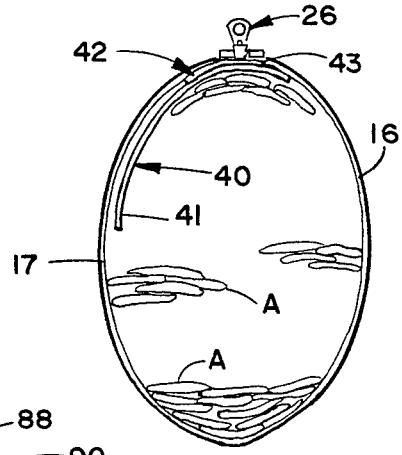
FIG. 6 is a fragmentary sectional view of a filled bag taken along line 6—6 of FIG. 5.

As shown most clearly by FIG. 6, the bag is designed so that the slide fastener coacting means 32,34 cannot come into contact with the bag contents. Secured to and depending from the inner, upper portions of the panel 16 is an elongated flap 40, and secured to and depending from the inner, upper portions of panel 17 is a relative shorter flap 42. The flaps 40, 42 generally are of a length corresponding to the length of the panels 16,17.

After the bag has been filled with elongated, flexible articles A, the flap 40 is pulled from alongside the side wall panel 16 and placed over the top of the articles within the bag and with edge portions 41 positioned adjacent sidewall panel 17. The edge portions 43 of flap 42 are then placed in overlapping relation to the flap 40. Upon closing of the bag by fastener 26, the flaps 40, 42 prevent the coacting elements 32,34 of the fastener from contacting the delicate articles A within the bag.

Figure 2:
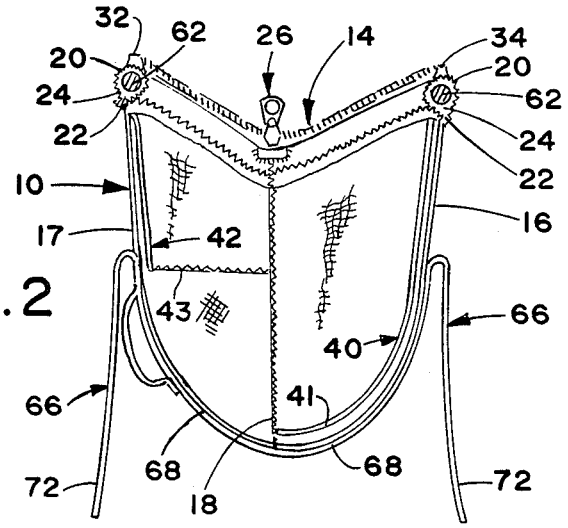
FIG. 2 is a cross-sectional view of the bag taken along line 2—2 of FIG. 1.

The bag, when in an opened condition for receiving articles is supported by frame assembly 12. In the embodiment of FIGS. 1 and 2 the assembly 12 comprises a rigid frame or stand which may be constructed of tubular or rod like members including support legs 52, 54 coupled by members 56, 58, 60. The legs 54,54 extending therefrom in cantilever fashion a pair of generally horizontally extending parallel rods 62,62. The openings 24,24 of the bag are of such a size for receiving rods 62,62.

Upon filling of a bag with articles, the flaps 40,42 are placed in overlapping relation over the articles and the bag slidably removed from rods 62,62. The bag then is closed by fastener 26.

Figure 5:
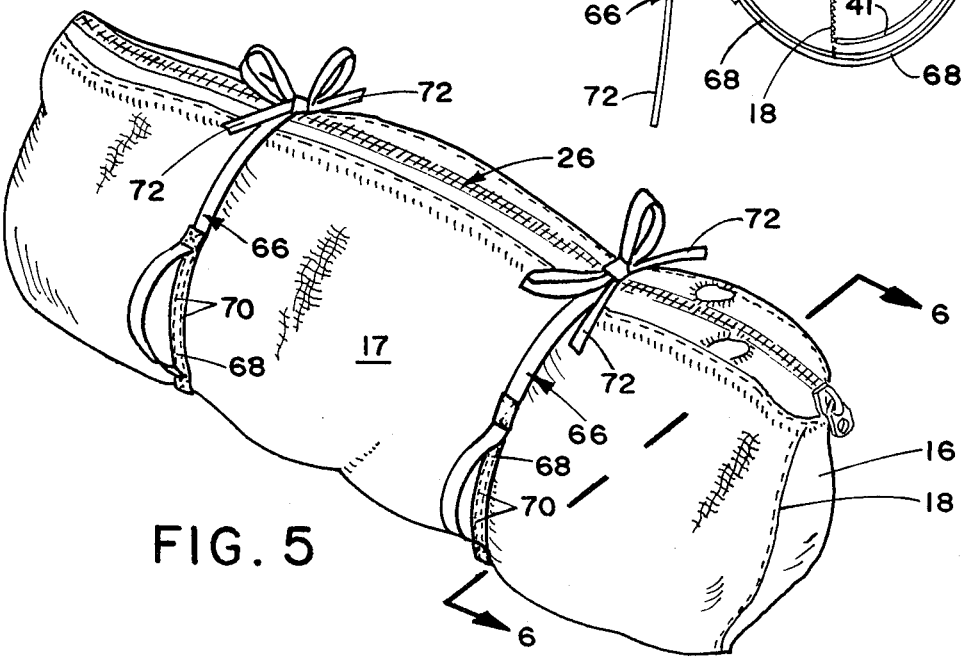
FIG. 5 is a perspective view of a closed and secured filled bag.

Spaced ties 66, as shown by FIG. 5 are provided to retain the articles in position within the bag. The ties 66,66 have portions 68,68 sewn to the bag side wall panels 16,17 as at 70, and loose portions 72,72 may be tied together, as shown. Also sewed to one of the panels, panel 17 in FIG. 5, are straps or handles 76,76 for use in readily lifting the filled bag. In the preferred embodiment, the handles 76,76 are in overlapping relation to the ties 66,66. The ties and handle may be formed of the same fabric as that of the bag panels 16,17.

Figure 3:
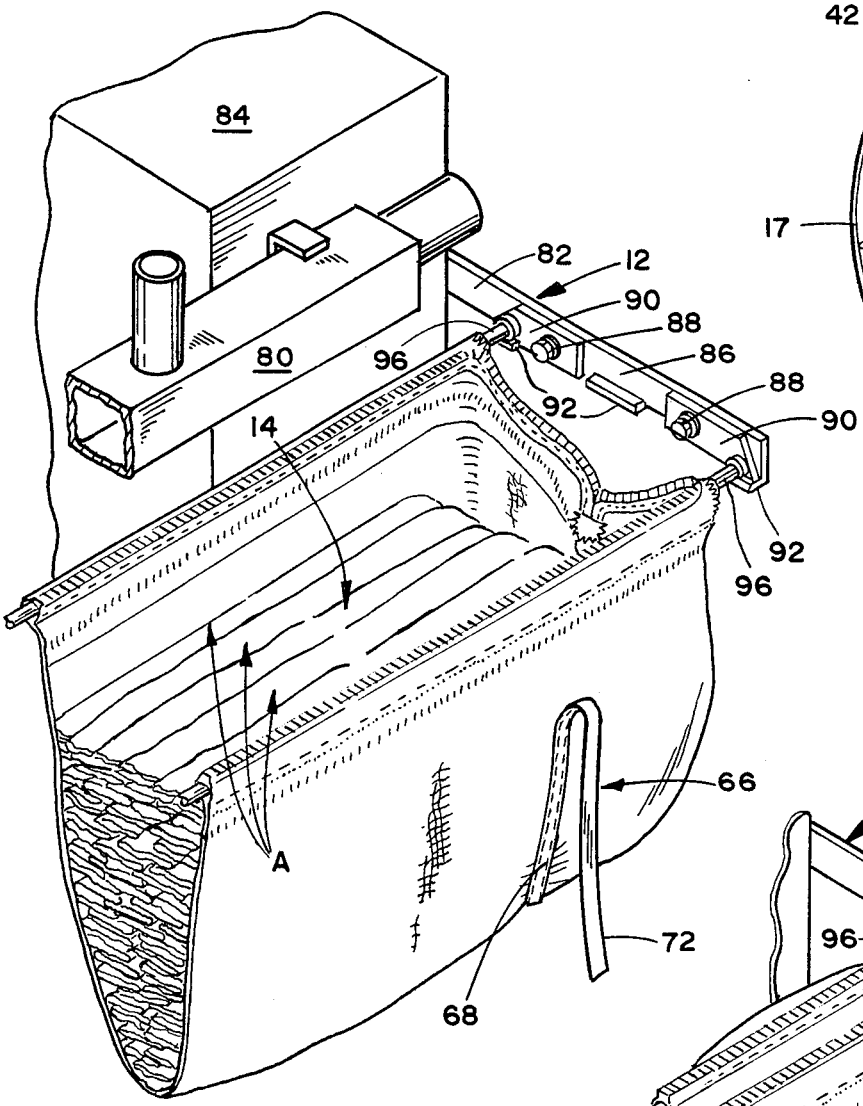
FIG. 3 is a schematic, fragmentary, perspective view of a bag of the invention associated with support apparatus mounted upon a machine frame and with apparatus for orienting the hosiery articles such that they are selectively positioned within the bag.
Figure 4:
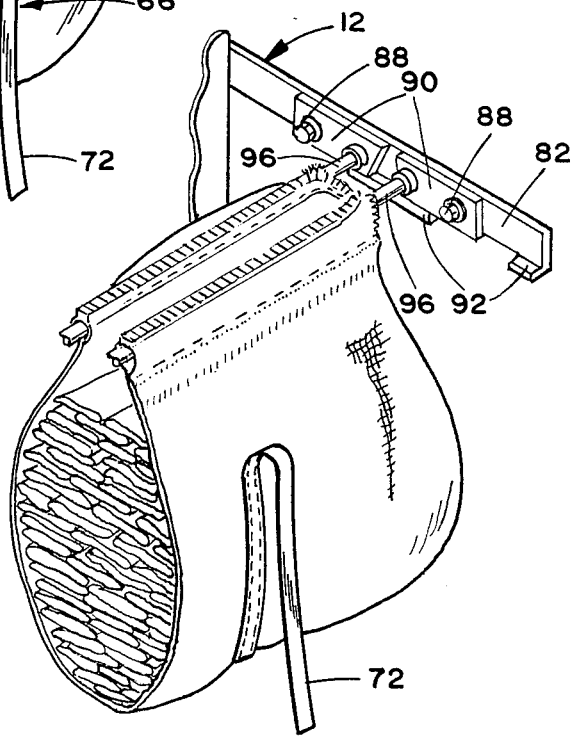
FIG. 4 is a schematic, fragmentary, perspective view of the bag mounted upon a frame attached to a machine and with the bag opening being partially closed.

FIGS. 3 and 4 illustrate the bag and support frame in association with a knitting machine 84 and an article orienting device 80. However, it is to be understood that such bag and frame could be readily associated with other machines and operations. Articles A automatically discharged from a knitting machine may be pneumatically directed to an orienting mechanism 80 positioned above an opened bag 10 and support frame 12. The mechanism 80 may be of the type disclosed in U. S. Pat. Nos. 4,099,789, 3,844,621 or the like which extends the articles as they are discharged therefrom and deposits them in an orderly, parallel fashion, as shown by FIG. 3.

The frame 12, FIGS. 3 and 4, may include an elongated member 82 mounted upon a knitting machine 84, or other machine or support. The frame 12 includes a generally horizontally extending bar or plate 86, having pivotably supported thereon by pivot members 88,88, a pair of spaced plates 90,90. Stop members 92 are welded or otherwise secured to selected portions of plate 86 to limit movement of and support the spaced plates 90,90 in the positions of either FIG. 3 or FIG. 4. Extending generally horizontally from each plate 90 is a rod-like member 96. The bag fabric defining openings 24,24 is slid over the unsupported end of rods 96,96 and the opened bag supported beneath the orienting mechanism 80. After a selected number of articles A have been deposited in bag 10, an operator pivots the plates 90,90 from the FIG. 3 position to the FIG. 4 position resulting in the interlocking elements 32,34 of the bag fastener being in close relation. The zipper fastener is actuated to close the bag and the end portions 72,72 of the ties 66 are tied to secure the contents of the bag. The flaps 40,42 are positioned over the articles in either the FIG. 3 or FIG. 4 position of the members 96,96.

Bags 10 and support frames 12 may be selectively used individually or with various selected machines or operations such as knitting machines 84, hosiery toe closing machines 102, autoclaves 104, hosiery line closer machines 106 and dyeing 108 and boarding machines 110, or other machines or operations, as desired.

Figure 7:
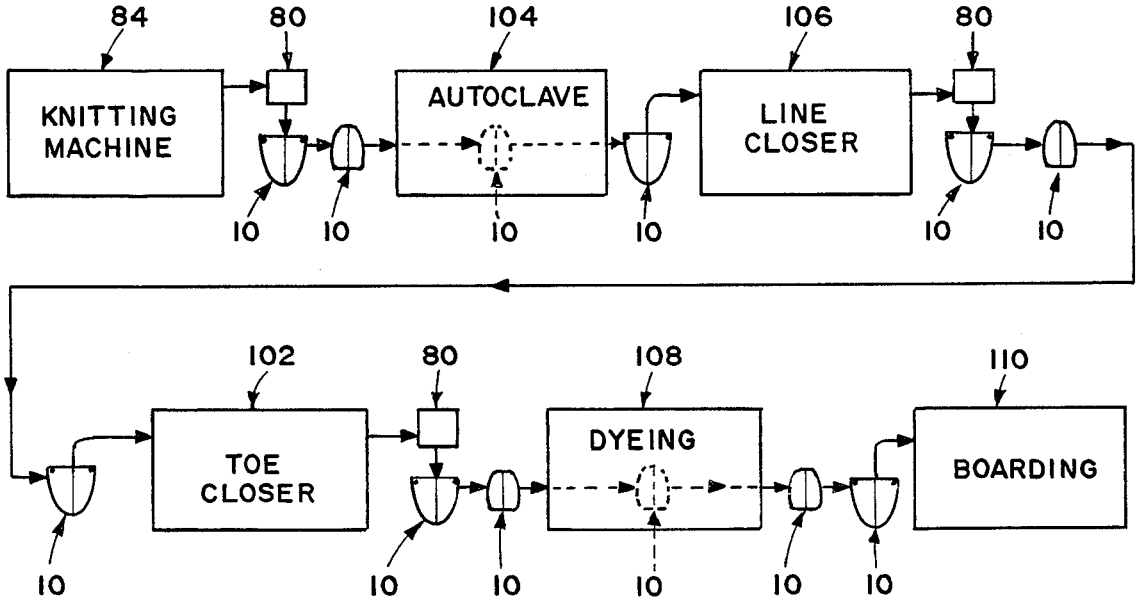
FIG. 7 is a flow chart representation illustrating one system for handling hosiery articles.

FIG. 7 illustrates one example of a system for handling hosiery articles. Knit articles are directed pneumatically from a knitting machine 84, through an orientation device 80 and into an opened bag 10 mounted in an opened condition upon a support frame 12. The filled bag is closed, the straps 72 tied and the bag conveyed to an autoclave 104. After the autoclave operation the tied bag may be conveyed to a line closer where an operator opens the bag and mounts it upon a support frame. The operator removes the oriented articles sequentially and loads them onto a line closer 106. The sewn articles may be automatically removed from the line closer, directed through orientation device 80 and again deposited in an opened bag in a prescribed manner. The bag again is closed, tied and conveyed to a toe closing machine 102. After another sewing operation the articles again are deposited in a bag in an oriented manner. Filled closed and tied bags may be placed in a dyeing machine 108 where the bags and articles remain stationary and the dye bath is forced through the open mesh bags and articles. After dyeing, the bags may be moved to a boarding operation where the oriented, dyed articles are removed by an operator and placed upon support forms of a boarding machine 110.

As the bags move from operation to operation, no orientation of articles by an operator is required. The extended oriented articles are maintained in a generally parallel relation with, in the case of hosiery articles, the toe portions all being at one end of the bag.

What is claimed is:

1. A carrier for use in retaining a plurality of delicate, flexible, elongated articles in an extended, oriented manner during transport of the carrier and during operations performed on articles when in the carrier comprising; opposed side wall panels having the lowermost portions thereof connected together and having opposite end portions stitched together to define a bag portion having an upwardly opening, elongated mouth extending generally the full length of said side wall panels, uppermost portions of each of said side wall panels being folded upon itself and stitched for defining elongated openings for receiving carrier support means, closure means secured to said side wall panels adjacent the uppermost portions thereof for selectively opening or closing said bag mouth, means secured to inner portions of at least one of said side wall panels for preventing articles within the carrier from contacting said closure means, and tie means having portions secured to said side wall panels for selectively encompassing said side wall panels for retaining articles within said carrier in an oriented, secured manner, said side wall panels being of an open mesh, soft fabric.

2. An article carrier as recited in claim 1, said means secured to inner portions of at least one of said side wall panels comprising a first fabric flap secured to one of said side wall panels adjacent the inner upper portions thereof, and a second fabric flap secured to the other panel of said side wall panels.

3. An article carrier as recited in claim 2, wherein said first and second fabric flaps are positioned in overlapping relation over a plurality of articles for separating the articles from said closure means.

4. An article supporting assembly for use in receiving and maintaining a plurality of elongated delicate hosiery articles in a prescribed oriented manner including; an elongated, generally horizontally disposed bag having an upwardly opening mouth extending substantially the entire length of said bag for receiving elongated, extended articles therein, means for supporting said bag in said horizontally disposed manner, means for selectively closing said bag, said bag further including means for preventing engagement of said means for closing said bag with articles within the bag, said bag including flexible tie means for selectively retaining articles in a secure oriented condition within said bag, said means for supporting said bag including a pair of spaced parallel support members mounted in cantilever fashion, said bag including portions defining openings for receiving said spaced, parallel support members.

5. An article supporting assembly as recited in claim 4, said means for supporting said bag further including means for permitting displacement of said spaced, parallel support members towards and away from each other to vary the size of the bag mouth.

6. An article supporting assembly for use in retaining a plurality of delicate, flexible, elongated hosiery articles in an extended, oriented manner comprising; opposed side wall panels having the lowermost portions thereof connected together and having opposite end portions connected together to define a bag portion having an upwardly opening mouth extending generally the full length of said side wall panels, selected upper portions of each of side wall panels being secured for defining elongated openings, means within said elongated openings for supporting said bag portion, said supporting means including spaced, parallel rod-like elements, closure means secured to said opposed side wall panels for selectively closing said bag portion, fabric means secured to said side wall panels for positioning in overlapping relations to articles within said bag portion, tie means secured to said side wall panels for selectively encompassing said side wall panels, said rod-like elements being mounted in cantilever fashion upon a support frame.

7. An assembly as recited in claim 6, wherein said support frame includes pivotally disposed members for displacing said rod-like elements towards or away from each other.

* * * * *